US010674886B2

(12) United States Patent
Li et al.

(10) Patent No.: US 10,674,886 B2
(45) Date of Patent: Jun. 9, 2020

(54) SPIN-DRY MOP

(71) Applicant: JIAXING JACKSON TRAVEL PRODUCTS CO., LTD, Jiaxing (CN)

(72) Inventors: Jing Li, Jiaxing (CN); Juhong Zhang, Jiaxing (CN); Hongliang Gan, Jiaxing (CN)

(73) Assignee: JIAXING JACKSON TRAVEL PRODUCTS CO., LTD. (CN)

( * ) Notice: Subject to any disclaimer, the term of this patent is extended or adjusted under 35 U.S.C. 154(b) by 46 days.

(21) Appl. No.: 15/992,553

(22) Filed: May 30, 2018

(65) Prior Publication Data

US 2019/0125157 A1 May 2, 2019

(30) Foreign Application Priority Data

Oct. 31, 2017 (CN) ..... 2017 2 1431962 U
Jan. 16, 2018 (CN) ..... 2018 2 0063523 U

(51) Int. Cl.
*A47L 13/14* (2006.01)
*B25G 1/04* (2006.01)

(52) U.S. Cl.
CPC ..... *A47L 13/14* (2013.01); *B25G 1/04* (2013.01)

(58) Field of Classification Search
CPC ..... A47L 13/14; B25G 1/04
USPC ..... 15/119.1
See application file for complete search history.

(56) References Cited

U.S. PATENT DOCUMENTS 6,125,494 A * 10/2000 Morad ..... A47L 13/14 15/120.1
6,732,396 B2 * 5/2004 Laux ..... A47L 13/142 15/116.1
8,011,055 B2 * 9/2011 Lesley ..... A47L 13/142 15/119.1
2009/0307855 A1 * 12/2009 Kao ..... A47L 13/142 15/3
2011/0274481 A1 * 11/2011 Chen ..... A47L 13/20 403/109.1
2015/0282685 A1 * 10/2015 Zhu ..... A47L 13/14 15/119.2

FOREIGN PATENT DOCUMENTS

CN 203447246 U 2/2014
CN 103417168 A 8/2016
WO WO2015/010577 A1 1/2015

* cited by examiner

*Primary Examiner* — Marc Carlson

(57) ABSTRACT

A spin-dry mop comprising a rotatable mop rod, a cleaning body, an outer cover and a fixing sleeve; the rotatable mop rod comprises an upper tube, a lower tube and a rotating driving mechanism; the upper tube and the lower tube are movably connected through the rotating driving mechanism; the upper tube and the lower tube can move up and down relative to each other, and can rotate relative to each other; the cleaning body is connected to the lower tube; the outer cover is sleeved outside the lower tube, and can move up and down along the lower tube; the fixing sleeve is fixedly connected with the upper tube; the spin-dry mop further comprises a locking mechanism used for locking the rotatable mop rod.

8 Claims, 7 Drawing Sheets

SPIN-DRY MOP

TECHNICAL FIELD OF THE INVENTION

The present invention relates to the technical field of cleaning tools, and more particularly, to a spin-dry mop.

BACKGROUND OF THE INVENTION

Chinese patent WO2015/010577A1 discloses a rotatable spin-dry mop comprising a mop rod mechanism, wherein the mop rod mechanism comprises an upper tube and a lower tube that are locked via a locking member. An abutting portion is formed at the first end of the locking member, and a pulling portion is formed at the second end of the locking member. During operation, a user needs to hold the mop rod by one hand, and operate the trigger by the other hand to lock the upper tube and the lower tubes. The aforesaid design has shortcomings such as complicated operation and poor user experience.

Chinese patent CN103417168A also discloses a rotatable mop capable of being spin-dried, which comprises a dehydrating mechanism that is sleeved outside the lower tube, and can move up and down along the lower tube. The dehydrating mechanism further comprises a locking sleeve, a splash guard and a water outlet cover. The water outlet cover is sleeved outside the lower tube, and the locking sleeve is sleeved outside the water outlet cover. A locking mechanism is disposed on the water outlet cover and the locking sleeve, and is capable of interacting with the lower tube. When the mop head needs to be spin-dried, the dehydrating mechanism can be pushed downwards. Due to the through-grooves formed in the locking sleeve, elastic deformation can be generated at the upper end of the locking sleeve. When the through-grooves slide out of the convex ribs that are disposed at the lower end of a protective sleeve, the dehydrating mechanism can slide downwards along the lower tube until the mop head entirely enters into the inner chamber of the water outlet cover. After the mop head is spin-dried, the dehydrating mechanism can be pulled upwards. As a result, the through-grooves in the locking sleeve and the convex ribs on the periphery of the lower end of the protective sleeve are engaged. At this point, the dehydrating mechanism is hung at the lower end of the protective sleeve, and the mop is ready for use. Although the elastic deformation generated at the upper end of the locking sleeve allows the through-grooves in the locking sleeve to slide out of or be engaged with the convex ribs, the operating process is extremely labor-consuming. Even worse, the aforesaid locking mechanism can be easily worn after prolonged use, which is inconvenient for later use.

SUMMARY OF THE INVENTION

The purpose of the present invention is to solve the shortcomings in the prior art by providing a spin-dry mop, which has a reasonable structure and can be conveniently operated.

To achieve the above purpose, the present invention adopts the following technical solution:

A spin-dry mop comprising a rotatable mop rod, a cleaning body, an outer cover and a fixing sleeve; the rotatable mop rod comprises an upper tube, a lower tube and a rotating driving mechanism; the upper tube and the lower tube are movably connected through the rotating driving mechanism; the upper tube and the lower tube can move up and down relative to each other, and can rotate relative to each other;

the cleaning body is connected to the lower tube; the outer cover is sleeved outside the lower tube, and can move up and down along the lower tube; the fixing sleeve is fixedly connected with the upper tube; the spin-dry mop further comprises a locking mechanism used for locking the rotatable mop rod; the locking mechanism comprises a first limiting mechanism capable of limiting the lower tube and the outer cover in the circumferential direction, a second limiting mechanism capable of limiting the upper tube and the outer cover in the circumferential direction, and an engaging mechanism that is disposed between the fixing sleeve and the outer cover; when the outer cover and the fixing sleeve are engaged, the rotatable mop rod can be locked.

In another aspect of the present invention, the first limiting mechanism comprises a tooth sleeve and an inner tooth that is arranged on the outer cover. The tooth sleeve and the lower tube are fixedly mounted. When the outer cover and the fixing sleeve are engaged through the engaging mechanism, the inner tooth is meshed with the tooth sleeve.

In another aspect of the present invention, the second limiting mechanism comprises a tooth groove that is arranged on the fixing sleeve, and an outer tooth that is arranged on the outer cover. When the outer cover and the fixing sleeve are engaged through the engaging mechanism, the outer tooth is meshed with the tooth groove.

In another aspect of the present invention, the first limiting mechanism comprises a tooth sleeve and an inner tooth that is arranged on the outer cover. The tooth sleeve and the lower tube are fixedly mounted. The second limiting mechanism comprises a tooth groove that is arranged on the fixing sleeve, and an outer tooth that is arranged on the outer cover. When the outer cover is engaged with the fixing sleeve through the engaging mechanism, the outer tooth is meshed with the tooth groove, and the inner tooth is meshed with the tooth sleeve.

In another aspect of the present invention, the engaging mechanism comprises a concave position that is arranged on the inner wall of the fixing sleeve, and a jumping hook that is arranged on the outer cover.

In another aspect of the present invention, the end portion of the inner tooth is gradually thinned.

In another aspect of the present invention, the end portion of the outer tooth is gradually thinned.

In another aspect of the present invention, the spin-dry mop comprises a cleaning body connecting piece that is connected with the cleaning body. A buckle mechanism capable of buckling or unbuckling the outer cover and the cleaning body connecting piece is arranged between the outer cover and the cleaning body connecting piece. The buckle mechanism comprises a sliding sleeve, a hanging hook and a driving mechanism used for propelling the sliding sleeve to axially slide along the rotatable mop rod. A mounting portion used for mounting the hanging hook is arranged on the side wall of the outer cover. The mounting portion comprises a through-hole and a hanging rod. A protruding rod corresponding to the hanging rod is arranged at one end of the hanging hook. The other end of the hanging hook is a hook portion. The hook portion comprises a hook heel portion and a hook tip portion. A plumb line is made at the position where the protruding rod is located, and the hook heel portion and the hook tip portion are respectively located on the two sides of the plumb line. The sliding sleeve is sleeved on the rotatable mop rod. When mounting the hanging hook, the protruding rod and the hanging rod are overlapped up and down, and when the sliding sleeve abuts against the hook heel portion, the hanging hook penetrates through the through-hole so that the cleaning body connecting piece can be firmly hooked by the hanging hook. When the sliding sleeve moves to the position where the hanging rod is located, the hanging hook is separated from the cleaning body connecting piece.

In another aspect of the present invention, the spin-dry mop comprises blocking edges used for limiting the hanging hook, and the hanging hook is arranged between the two blocking edges.

In another aspect of the present invention, the hook tip portion is provided with a bevel edge.

In another aspect of the present invention, the driving mechanism comprises a button, a spring, a pressure spring and an inclined surface that is arranged on the side wall of the sliding sleeve. The spring is sleeved outside the rotatable mop rod, and imposes a force onto the sliding sleeve, enabling the sliding sleeve to move downwards to abut against the hook heel portion. A force bearing surface that can abut against the sliding sleeve to enable the sliding sleeve to be far away from the hook heel portion is arranged on the button. The pressure spring can impose a force onto the button so that the button can be reset.

In another aspect of the present invention, the cleaning body comprises a base, a side plate and a mop cloth, wherein the base is rotationally connected with the side plate, and the two ends of the mop cloth are fixedly connected with the side plate.

In another aspect of the present invention, the cleaning body comprises a flexible plate and a mop cloth. The mop cloth is fixedly connected with the flexible plate.

In another aspect of the present invention, the cleaning body can be a traditional cleaning body comprising a mop plate and a mop cloth. The deformation can be generated according to the own properties of the mop.

Compared with the prior art, the present invention has the following advantages:

It's unnecessary to lock the rotatable mop rod through operating the traditional trigger. When the outer cover of the present invention moves upwards, the self-cleaning state can be switched to the mopping state and the rotatable mop rod can be simultaneously locked. Moreover, the mopping state and the dehydrating state can be conveniently switched via controlling the buckling or unbuckling of the buckle mechanism through the driving mechanism. Thus, the traditional labor-consuming method utilizing the frictional force can be replaced, greatly reducing the abrasion of components.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

DETAILED DESCRIPTION OF THE INVENTION

Drawings and detailed embodiments are combined hereinafter to elaborate the technical principles of the present invention.

Figure 1:
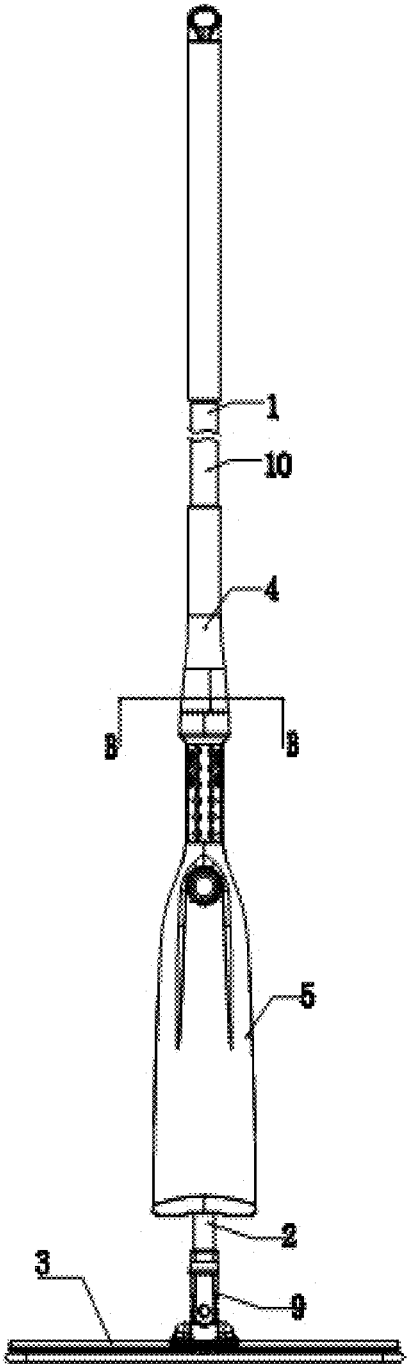
FIG. 1 is a structural diagram of the present invention.
Figure 2:
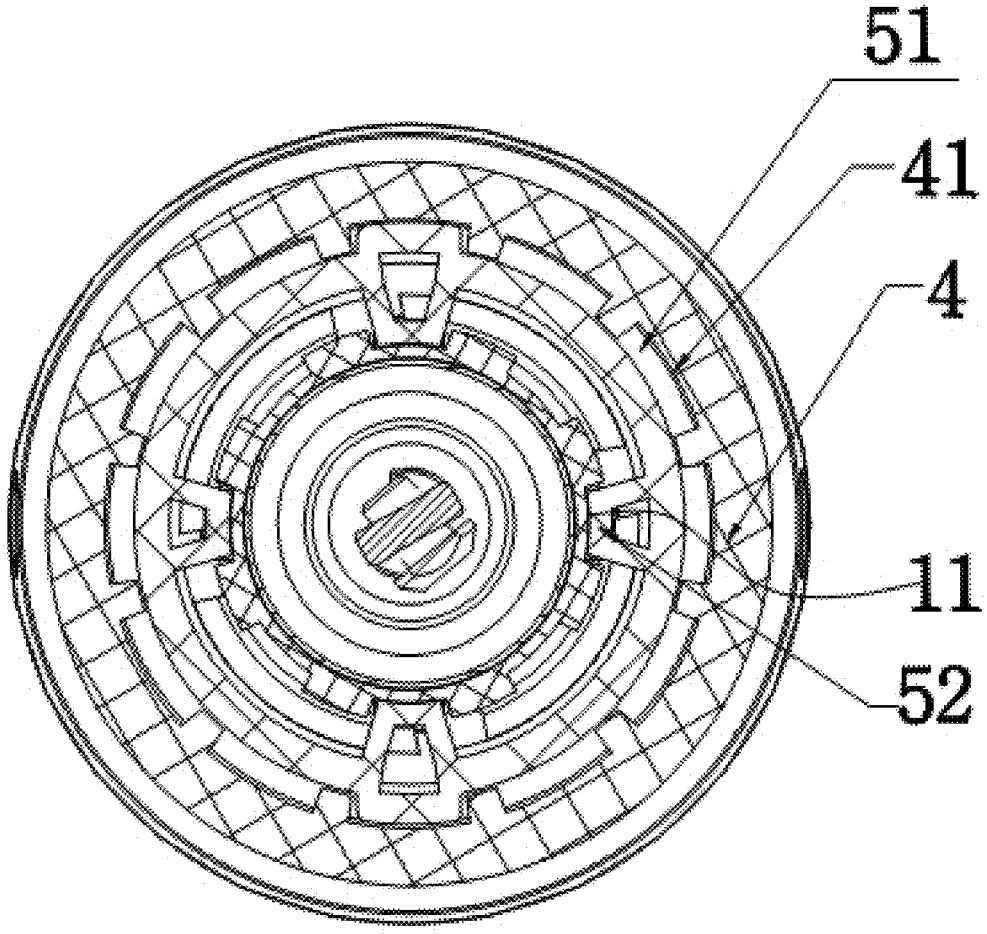
FIG. 2 is a sectional view of FIG. 1 in B-B direction.
Figure 3:
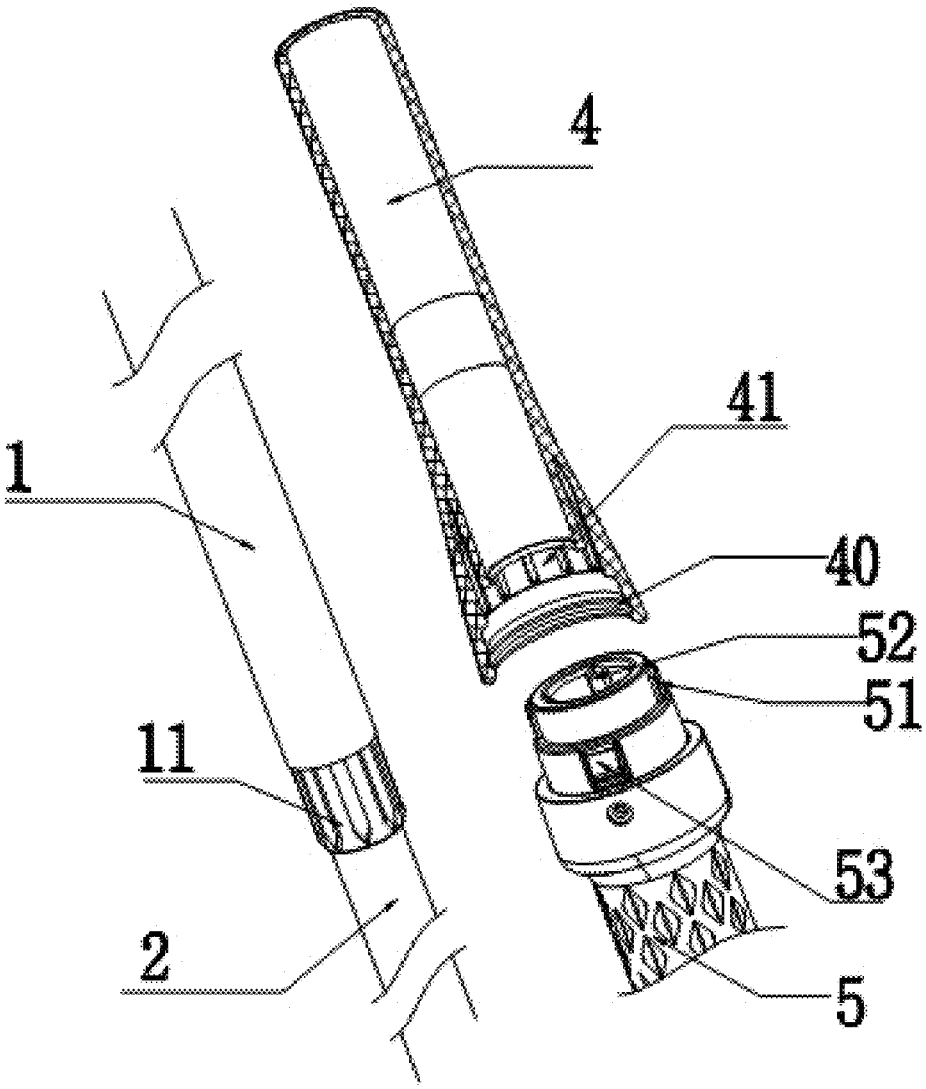
FIG. 3 is an explosive view of the locking mechanism of the present invention.
Figure 4:
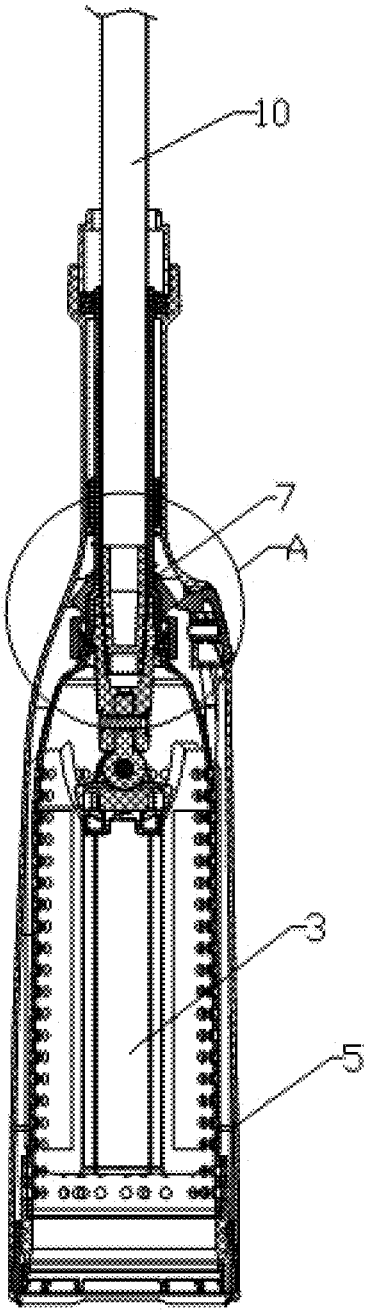
FIG. 4 is a sectional view of FIG. 1.
Figure 5:
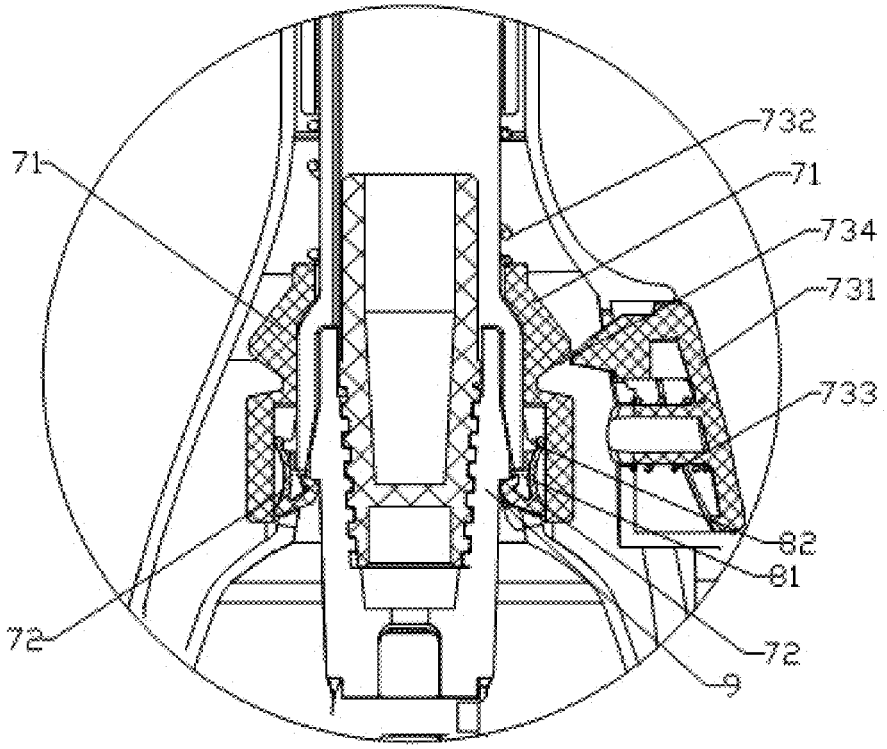
FIG. 5 is an enlarged view of portion A in FIG. 4.
Figure 6:
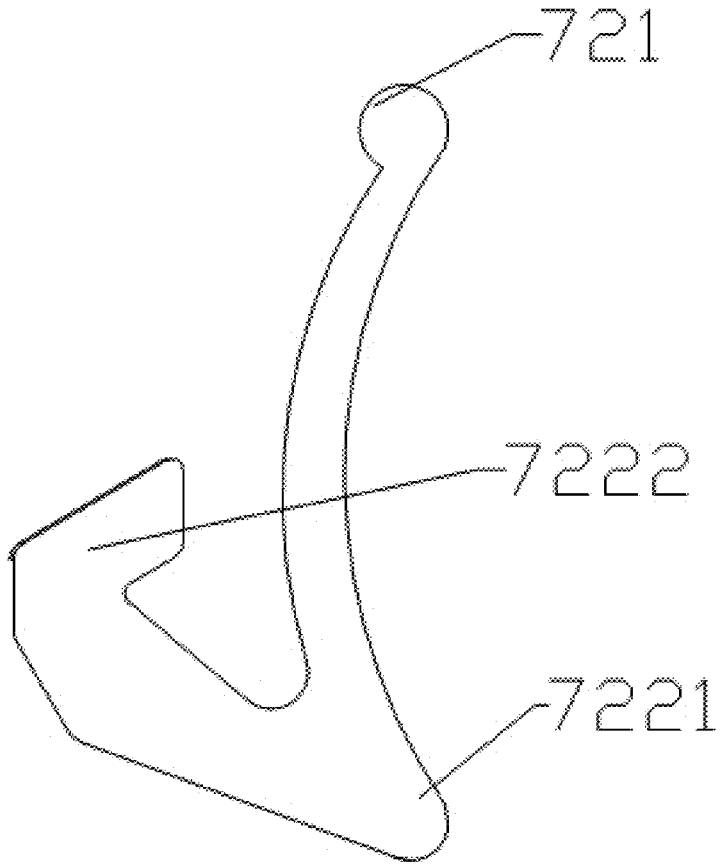
FIG. 6 is a structural diagram of the hanging hook of the present invention.
Figure 7:
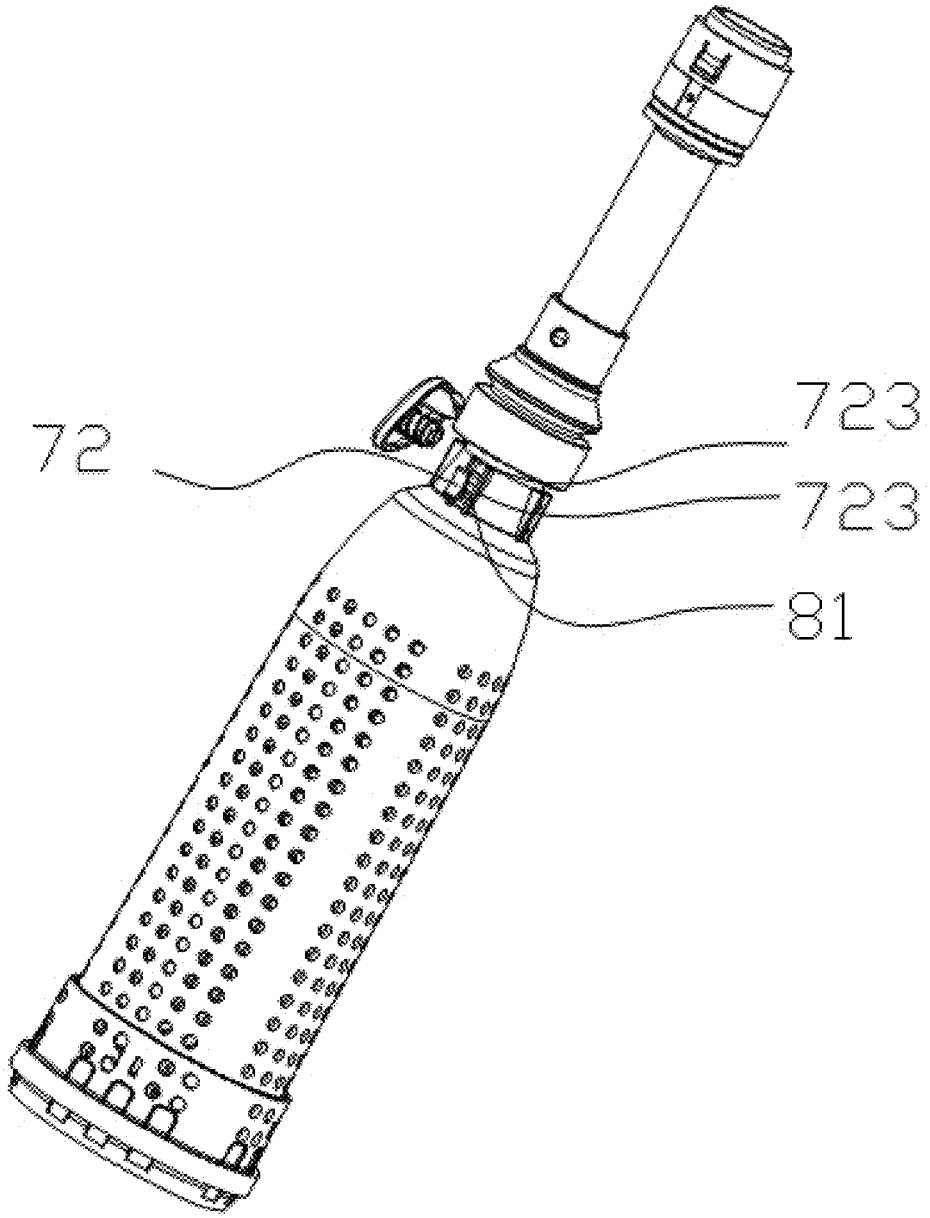
FIG. 7 is a schematic diagram illustrating the mounting structure of the hanging hook of the present invention.

As shown in FIGS. 1-3, the spin-dry mop of the present invention comprises a rotatable mop rod 10, a cleaning body 3, an outer cover 5 and a fixing sleeve 4. The rotatable mop rod 10 comprises an upper tube 1, a lower tube 2 and a rotating driving mechanism. The upper tube 1 and the lower tube 2 are movably connected through the rotating driving mechanism. The upper tube 1 and the lower tube 2 can move up and down relative to each other, and can rotate relative to each other. The lower tube 2 is connected to the cleaning body 3. The rotating driving mechanism of the rotatable mop rod 10 of this embodiment has been disclosed in Chinese patent CN203447246U.

In this embodiment, the cleaning body 3 is connected to the lower tube 2. The outer cover 5 is sleeved outside the lower tube 2, and can move up and down along the lower tube 2. During the dehydrating process, the cleaning body 3 is partially or entirely located in the outer cover 5. The upper tube 1 and the lower tube 2 move up and down so that the cleaning body 3 can be spin-dried through the rotating driving mechanism. When mopping the floor, the lower tube 2 can be pushed downwards, thereby enabling the cleaning body 3 to be located outside the outer cover 5. In this embodiment, the fixing sleeve 4 is fixedly connected with the upper tube 1.

The spin-dry mop of this embodiment further comprises a locking mechanism used for locking the rotatable mop rod 10. The locking mechanism comprises a first limiting mechanism capable of limiting the lower tube 2 and the outer cover 5 in the circumferential direction, a second limiting mechanism capable of limiting the upper tube 1 and the outer cover 5 in the circumferential direction, and an engaging mechanism that is disposed between the fixing sleeve 4 and the outer cover 5. When the outer cover 5 and the fixing sleeve 4 are engaged, the rotatable mop rod 10 can be locked. The lower tube 2 and the outer cover 5 are limited in the circumferential direction, and the upper tube 1 and the outer cover 5 are limited in the circumferential direction. As the fixing sleeve 4 is fixedly connected with the upper tube 1, when the outer cover 5 is engaged with the fixing sleeve 4, the upper tube 1 and the lower tube 2 are also relatively fixed.

In another preferred embodiment, the first limiting mechanism comprises a tooth sleeve 11 and an inner tooth 52 that is arranged on the outer cover 5. The tooth sleeve 11 and the lower tube 2 are fixedly mounted. When the outer cover 5 and the fixing sleeve 4 are engaged through the engaging mechanism, the inner tooth 52 is meshed with the tooth sleeve 11. Preferably, the end portion of the inner tooth 52 is gradually thinned relative to the main body of the inner tooth 52. Thus, the inner tooth 52 and the tooth sleeve 11 can be meshed more smoothly.

In another preferred embodiment, the second limiting mechanism comprises a tooth groove 41 that is arranged on the fixing sleeve 4, and an outer tooth 51 that is arranged on the outer cover 5. When the outer cover 5 and the fixing sleeve 4 are engaged through the engaging mechanism, the outer tooth 51 is meshed with the tooth groove 41. Preferably, the end portion of the outer tooth 51 is gradually thinned relative to the main body of the outer tooth 51 so that the outer tooth 51 and the fixing sleeve 4 can be better meshed.

In another preferred embodiment, the first limiting mechanism comprises a tooth sleeve 11 and an inner tooth 52 that is arranged on the outer cover 5. The tooth sleeve 11 and the lower tube 2 are fixedly mounted. The second limiting mechanism comprises a tooth groove 41 that is arranged on the fixing sleeve 4, and an outer tooth 51 that is arranged on the outer cover 5. Namely, when the outer cover 5 is engaged with the fixing sleeve 4 through the engaging mechanism, the outer tooth 51 is meshed with the tooth groove 41, and the inner tooth 52 is meshed with the tooth sleeve 11.

In this embodiment, the aforesaid components of the present invention are in concave-convex fit instead of being tightly engaged. In practical use, a gap may exist between the components due to the assembly errors.

Furthermore, the engaging mechanism of this embodiment comprises a concave position 40 that is arranged on the inner wall of the fixing sleeve 4, and a jumping hook 53 that is arranged on the outer cover 5. When the outer cover 5 and the fixing sleeve 4 are engaged through the engaging mechanism, the jumping hook 53 is expanded in the concave position 40, thereby achieving the opening or closing between the outer cover 5 and the fixing sleeve 4 in the expanded state.

In this embodiment, the concave position 40 is arranged underneath the fixing sleeve 4, and the jumping hook 53 is arranged underneath the outer tooth 51. When the outer cover 5 approaches the fixing sleeve 4, the upper tube 1 and the lower tube 2 are locked by the limiting mechanism.

As shown in FIGS. 4-7, in order to achieve a labor-saving operation, the spin-dry mop of the present invention further comprises a cleaning body connecting piece 9 that is connected with the cleaning body 3. A buckle mechanism 7 capable of buckling or unbuckling the outer cover 5 and the cleaning body connecting piece 9 is arranged between the outer cover 5 and the cleaning body connecting piece 9. The buckle mechanism 7 comprises a sliding sleeve 71, a hanging hook 72 and a driving mechanism used for propelling the sliding sleeve 71 to axially slide along the rotatable mop rod. A mounting portion used for mounting the hanging hook 72 is arranged on the side wall of the outer cover 5. The mounting portion comprises a through-hole 81 and a hanging rod 82. A protruding rod 721 corresponding to the hanging rod 82 is arranged at one end of the hanging hook 72. A step portion or a concave portion that can be firmly hooked by the hanging hook 72 is arranged on the cleaning body connecting piece 9. The hanging hook 72 can move towards the cleaning body connecting piece 9 through the sliding sleeve 71 so that the cleaning body connecting piece 9 can be stably hooked by the hanging hook 72. The other end of the hanging hook 72 is a hook portion. The hook portion comprises a hook heel portion 7221 and a hook tip portion 7222. A plumb line is made at the position where the protruding rod 721 is located, and the hook heel portion 7221 and the hook tip portion 7222 are respectively located on the two sides of the plumb line. When the outer cover 5 is buckled with the cleaning body connecting piece 9, the sliding sleeve 71 abuts against the hanging hook 72, and the plumb line is inclined. When the outer cover 5 and the cleaning body connecting piece 9 are unbuckled, the sliding sleeve 71 no longer abut against the hanging hook 72, enabling the hanging hook 72 to swing under the gravity action. Thus, the plumb line returns to the vertical direction, and the hook tip portion 7222 is far away from the cleaning body connecting piece 9.

In this embodiment, the two ends of the sliding sleeve 71 are respectively provided with an opening, and the sliding sleeve 71 is sleeved on the rotatable mop rod. When mounting the hanging hook 72, the protruding rod 721 and the hanging rod 82 are hung up and down. When the sliding sleeve 71 abuts against the hook heel portion 7221, the hanging hook 72 penetrates through the through-hole 81, and the cleaning body connecting piece 9 is hooked by the hanging hook 72. When the sliding sleeve 71 moves upwards, the hanging hook 72 is separated from the cleaning body connecting piece 9.

Further, the spin-dry mop of the present invention comprises two blocking edges 723 for limiting the hanging hook 72. The hanging hook 72 is arranged between the two blocking edges 723 so that it can be limited by the two blocking edges 723. By means of the two blocking edges 723, the hanging hook 72 can be prevented from deflecting or misaligning when it is in an unhooked state, enabling the hanging hook 72 to be smoothly switched.

The hook tip portion 7222 of the present invention is provided with a bevel edge. This design not only allows the cleaning body connecting piece 9 to be tightly hooked by the hanging hook 72 but enables the cleaning body connecting piece 9 to be flexibly separated from the hanging hook 72.

The driving mechanism of the present invention comprises a button 731, a spring 732, a pressure spring 733 and an inclined surface 734 that is arranged on the side wall of the sliding sleeve 71. The spring 732 is sleeved outside the rotatable mop rod, and imposes a force onto the sliding sleeve 71, enabling the sliding sleeve 71 to move downwards to abut against the hook heel portion 7221. Thus, the hanging hook 72 is propelled to penetrate through the through-hole 81 so that the cleaning body connecting piece 9 can be firmly hooked by the hanging hook 72. A force bearing surface that can abut against the sliding sleeve 71 to enable the sliding sleeve to be far away from the hook heel portion 7221 is arranged on the button 731. The pressure spring imposes a force onto the button 731, and the force bearing surface is gradually in contact with the inclined surface of the side wall of the sliding sleeve 71. As a result, the sliding sleeve 71 is far away from the hook heel portion 7221, and the button 731 is reset along with the pressure spring 733.

In this embodiment, the cleaning body 3 comprises a base, a side plate and a mop cloth, wherein the base is rotationally connected with the side plate, the two ends of the mop cloth are fixedly connected with the side plate, and the cleaning body 3 can be deformed. When mopping the floor, the cleaning body 3 can be expanded to improve the cleaning efficiency. After being dehydrated, the cleaning body 3 can be reduced to achieve a convenient self-cleaning.

In another embodiment, the cleaning body 3 comprises a flexible plate and a mop cloth. The mop cloth is fixedly connected with the flexible plate, and the cleaning body can be deformed.

Further, the cleaning body 3 can be a traditional cleaning body comprising a mop plate and a mop cloth. The deformation can be generated according to the own properties of the spin-dry mop.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A spin-dry mop, comprising:

a rotatable mop rod, a cleaning body, an outer cover, and a fixing sleeve, wherein the rotatable mop rod comprises an upper tube, and a lower tube, wherein the upper tube and the lower tube are movably connected, wherein the upper tube and the lower tube can move up and down relative to each other, and can rotate relative to each other, wherein the cleaning body is connected to the lower tube, wherein the outer cover is sleeved outside the lower tube, and can move up and down along the lower tube, wherein the fixing sleeve is fixedly connected with the upper tube, wherein when the outer cover and the fixing sleeve are engaged, the rotatable mop rod can be locked, wherein the spin-dry mop further comprising a cleaning body connecting piece that is connected with the cleaning body, wherein a buckle mechanism capable of buckling or unbuckling the outer cover and the cleaning body connecting piece is arranged between the outer cover and the cleaning body connecting piece, wherein the buckle mechanism comprises a sliding sleeve, a hanging hook and a driving mechanism used for propelling the sliding sleeve to axially slide along the rotatable mop rod, wherein a mounting portion used for mounting the hanging hook is arranged on the side wall of the outer cover, wherein the mounting portion comprises a through-hole and a hanging rod, wherein a protruding rod corresponding to the hanging rod is arranged at one end of the hanging hook, wherein the other end of the hanging hook is a hook portion, wherein the hook portion comprises a hook heel portion and a hook tip portion, wherein a plumb line is made at the position where the protruding rod is located, and the hook heel portion and the hook tip portion are respectively located on the two sides of the plumb line, wherein the sliding sleeve is sleeved on the rotatable mop rod, wherein when mounting the hanging hook, the protruding rod and the hanging rod are overlapped up and down, and when the sliding sleeve abuts against the hook heel portion, the hanging hook penetrates through the through-hole so that the cleaning body connecting piece can be firmly hooked by the hanging hook, wherein when the sliding sleeve moves towards the position where the hanging rod is located, the hanging hook is separated from the cleaning body connecting piece.

2. The spin-dry mop of claim 1, wherein the spin-dry mop comprises blocking edges used for limiting the hanging hook, and the hanging hook is arranged between the two blocking edges.

3. The spin-dry mop of claim 1, wherein the hook tip portion is provided with a bevel edge.

4. The spin-dry mop of claim 1, wherein the driving mechanism comprises a button, a spring, a pressure spring and an inclined surface that is arranged on the side wall of the sliding sleeve, wherein the spring is sleeved outside the rotatable mop rod, and imposes a force onto the sliding sleeve, enabling the sliding sleeve to move downwards to abut against the hook heel portion, wherein a force bearing surface that can abut against the sliding sleeve to enable the sliding sleeve to be far away from the hook heel portion is arranged on the button, wherein the pressure spring can impose a force onto the button so that the button can be reset.

5. The spin-dry mop of claim 1, wherein the cleaning body comprises a base, a side plate and a mop cloth, wherein the base is rotationally connected with the side plate, and the two ends of the mop cloth are fixedly connected with the side plate.

6. The spin-dry mop of claim 1, wherein the cleaning body comprises a base, a side plate and a mop cloth, wherein the base is rotationally connected with the side plate, and the two ends of the mop cloth are fixedly connected with the side plate.

7. The spin-dry mop of claim 1, wherein the cleaning body comprises a flexible plate and a mop cloth, wherein the mop cloth is fixedly connected with the flexible plate.

8. The spin-dry mop of claim 1, wherein the cleaning body comprises a flexible plate and a mop cloth, wherein the mop cloth is fixedly connected with the flexible plate.

* * * * *